US008984821B2

(12) United States Patent
Bruno

(10) Patent No.: US 8,984,821 B2
(45) Date of Patent: Mar. 24, 2015

(54) MODULAR DOOR ASSEMBLY

(71) Applicant: Treebus Inc., Woodbridge (CA)

(72) Inventor: Salvatore Bruno, Woodbridge (CA)

(73) Assignee: Treebus Inc., Woodbridge (CA)

( * ) Notice: Subject to any disclaimer, the term of this patent is extended or adjusted under 35 U.S.C. 154(b) by 0 days.

(21) Appl. No.: 13/713,723

(22) Filed: Dec. 13, 2012

(65) Prior Publication Data

US 2014/0165489 A1 Jun. 19, 2014

(51) Int. Cl.

| | |
|---|---|
| ***E06B 3/96*** | (2006.01) |
| ***E06B 3/964*** | (2006.01) |
| ***E06B 3/72*** | (2006.01) |
| ***E06B 3/984*** | (2006.01) |
| *E06B 3/70* | (2006.01) |

(52) U.S. Cl.

CPC . *E06B 3/72* (2013.01); *E06B 3/984* (2013.01); *E06B 2003/7096* (2013.01)

USPC ..... 52/210; 52/213; 52/654.1; 52/655.1; 52/286; 52/745.06

(58) Field of Classification Search

CPC ..... E06B 3/673; E06B 3/96; E06B 3/964; E06B 3/72

USPC ..... 52/281, 284, 285.4, 654.1, 655.1, 210, 52/213, 286

See application file for complete search history.

(56) References Cited

U.S. PATENT DOCUMENTS

| | | | | | |
|---|---|---|---|---|---|
| 635,341 | A * | 10/1899 | Nash | 52/656.4 |
| 2,938,248 | A * | 5/1960 | Hadary | 160/229.1 |
| 5,086,601 | A * | 2/1992 | Galowitz et al. | 52/656.2 |
| 5,261,203 | A * | 11/1993 | Yoon | 52/455 |
| 5,361,552 | A * | 11/1994 | Fulford | 52/455 |
| 5,775,041 | A * | 7/1998 | Tull et al. | 52/455 |
| 5,848,505 | A * | 12/1998 | Taylor | 52/202 |
| 6,250,040 | B1 * | 6/2001 | Green | 52/656.7 |
| 6,766,621 | B2 * | 7/2004 | Reppermund | 52/204.1 |
| 8,353,327 | B2 * | 1/2013 | Domingue et al. | 160/374.1 |
| 2005/0210797 | A1 * | 9/2005 | Hees | 52/455 |

* cited by examiner

*Primary Examiner* — Phi A

(74) *Attorney, Agent, or Firm* — Eric L. Lane

(57) ABSTRACT

The invention pertains to a technology of manufacturing and assembling modular doors, which can be assembled on site, and specifically to modular doors, which can be assembled without a use of glue, by mortize and tenons.

16 Claims, 18 Drawing Sheets

MODULAR DOOR ASSEMBLY

FIELD OF THE INVENTION

The current invention pertains to new and useful improvements to a door assembly process utilizing mortises, tenons and dowels as well as use of dowels for locking door stiles and rails.

BACKGROUND OF THE INVENTION

Millions of doors are assembled, installed and renovated every year. The process of manufacturing and assembling door is long and complicated; usually it takes several hours to assemble and install a door. Generally, the door is supplied as fully assembled with or without a frame. If the door is supplied without a frame, then prior to installation, the hinges and locks have to be drilled, cut and attached to the door and the frame. Generally, most of the doors have to be prepped for hardware prior to installations; this procedure requires a manipulation of a heavy door.

The manufacturing process requires that the door assembly be glued to keep the parts together, and during the gluing process the door has to be locked in special clamps to keep its integrity. The glue requires an extensive curing time before the rest of the door assembly can be completed. Following the gluing process, the door stiles have to be beveled in order to allow smooth closure of the door. The beveling process is known in the art and involves a removal of some layer(s) of material from the stiles on the hinge and/or lock side, thus creating a vertical plane with a slope of approximately 2-3 Degrees. Only after beveling can the whole door be sanded, prepped and painted or covered by protective layers known in the art.

This lengthy and involved door manufacturing process allows delivery of fully assembled doors. Delivery of doors in a disassembled state is not possible as the gluing and beveling process can only be performed on site. Furthermore, in the current process if a part or parts of the door are damaged during transportation, the entire door is considered broken and must be replaced.

In the case of a modular door, only the damaged part needs to be replaced.

The delivery of disassembled doors has the following benefits: they take less space, the risk of breakage is reduced, and if there are broken parts, they can be easily replaced by spare parts. However, disassembled doors need to be assembled on-site by the end user. Therefore, a kit for door assembly is required in which the stiles are beveled prior to the assembly. The assembly kit does not require any complicated tools and ordinarily does not require use of glue.

One of the technologies used in door building and manufacturing is the use of mortise and tenon. This technology is well-known and described for example, in U.S. Pat. No. 0,541,450. This patent teaches a door comprising styles and rails, which are suitably mortised and tenoned together while dowel pins are inserted into the long side of the stiles and pass through both tenons while remaining invisible. This locking means is generally used to improve sturdiness of the final product but does not eliminate the use of glue during the door assembly. There is a further technology of mortise and tenon with protruding dowel also disclosed in the U.S. Pat. No. 5,086,601. This Patent teaches a construction of frames for windows and doors while utilizing a joint structure with mortise and tenon.

The present invention addresses the deficiencies in prior art by providing an improved method of door assembly by reducing or virtually eliminating a use of glue. The invention also provides a kit for self-assembly of a modular door and method of manufacturing such kit.

SUMMARY OF THE INVENTION

The current invention pertains to new and useful improvements to a door assembly process utilizing mortises, tenons and dowels as well as use of dowels for locking door stiles and rails.

The primary aspect of the invention is to bevel and prep the hardware during the manufacturing process in such a way as to give the end user the ability to assemble a door without the use of glue or a door clamp press. The elimination of glue allows disassembly of the door if needed.

The glue-less construction of the door creates multiple advantages and options of improving the design, style, workability, integrity, reuse, and repair if needed as the process allows the end user to take the door apart after it has been assembled, resulting in a considerable savings in time and money by placing the customization factor into the users' hands.

The crux of the assembly is using a traditional mortise and tenon joint in the door assembly. In its preferred embodiment, a hole is created within the tenons on the rail at both ends while a slot is created along the entire body of the stile. This slot stops short of the mortises at the top and bottom of the stile. Thereafter, an oversized hole is drilled in the stile for accommodating the bushing. The bushing completes the slot, by retaining integrity of the stile and enabling rods to be pre-inserted without added friction. This function is useful during assembling or disassembling multiple rail configurations.

Preferably, the corresponding holes in the tenons and slots are slightly off-set to one another. In this way, when assembled the stiles and rails in combination with the dowel/bushings being driven into their final resting position create an opposing force so all mortise and tenons are pressed and locked together for all stiles and rails simultaneously. Finally, driving a screw through the bushing into the rail and/or stile locks the bushings and dowels in place.

If conforming to the teachings of the prior art, the door is usually assembled with glue and then placed into a clamp door press. Other necessary steps include pressing the joints, squeezing out the excess glue and waiting for the glue to cure. Once the glue has cured the door is removed, then beveled, and prepared for hardware installation.

In some applications in the prior art, the mortise and tenon are drilled once the door is fully assembled. This is done at the top and bottom railings of the door. The dowel is inserted to act only to keep the parts together; it is not used to close a gap between parts. Finally, in the prior art the mortise and tenon combination are used only on the top and bottom rails. The current invention allows to use locked mortise and tenon at the intermediate rails as well.

The current invention eliminates the use of glue and the use of a door clamp press, which has a direct result of eliminating the curing time, beveling and prepping for hardware after the assembly for the end user.

Beveling and prepping for hardware is done during the stile manufacturing process. The manufacturing process dictates the use of a clamp press with two parallel surfaces in order to prevent buckling and deformation of the door under force.

If needed, the stile can be matched to an existing opening, transcribing the original hardware placement to the new door or in this case stile. Since the single stile can be handled, the marking of the hardware makes this a much easier task to handle in place of a fully assembled door. After prepping the stile, the door can be assembled and immediately installed without a wait for glue curing and other door preparations utilized in prior art.

Another aspect of the invention is a use of extensions to the rails of the door. These extensions can be used on the top and/or bottom rails. The end user's choice of different materials such as wood, metal, Plexiglas, plastic or composite material extension will give the door a unique look. In addition, use of extensions can make it more resilient to the elements. Using a rubber or silicon cover on the extension may, for example, assist in reduction of water damage to the door. Furthermore, use of extensions would allow replacement of the extension only if it became soiled or broken, without need to replace the whole door.

According to one aspect of the invention there is provided a modular door having:

a. two pre-manufactured stiles having two ends and two sides, and provided with mortises along one of the sides and a rod receiving slots passing through said mortises
b. a top and a bottom pre-manufactured rail having two sides and two ends with tenon provided at each end while each tenon has a predrilled aperture to receive locking rod,
c. while the stiles and rails are enclosing at least one door panel,
d. at least one intermediate rail having tenons, positioned between the top rail and the bottom rail;
e. The said rails are attached to the first and second stiles by the means of mortises and tenons fastened in place by a set of rods.
f. Said set of rods comprises: locking rods of sufficient length to lock a single rail or a plurality of rails inside the corresponding stile. Said modular door can be assembled by insertion of the tenons of the rails into the corresponding mortises of the stiles followed by locking in place with the set of rods.

Preferably, each stile of the door comprises a slot for receiving rods. This slot extends from the top of the stile to the bottom of the stile passing through the mortises of the stile.

Preferably, the tenons of the rails have pre-drilled apertures to receive the locking rods, and upon insertion of each tenon into the corresponding mortise of each stile the rod receiving slot and aperture are position in an offset to one another. Thus, upon insertion of the locking rod, each tenon is tightly locked into its corresponding mortise.

In a preferred embodiment, the set of rods comprises pushing rods, locking rods, and locking/pushing rods. The pushing rods are provided to deliver the locking rods into the tenons of the intermediate rail, while the locking/pushing rods are provided to lock one rail as well as to push another locking or pushing rod through the rod receiving channel of the stile.

According to yet another aspect of the invention, the set of rods further comprises an unlocking rod having the length equal to the height of the tenon of the corresponding rail to be unlocked. These unlocking rods are positioned between the pushing rods and the locking rods, and can be pushed into the tenon of the rail while removing the locking rod from the tenon to release the intermediate rail from the stile.

According to yet another aspect of the invention the top and/or bottom rails include a receiving member to receive an extension to the door with a corresponding mating member. This extension to the door can be decorative or functional and can be easily replaced upon wear or change in utility.

According to one additional aspect of the invention, there is a kit for assembling a modular door comprising:

a. two pre-manufactured stiles having two ends and two sides, provided with mortises along one of the sides and a rod receiving slots passing through said mortises;
b. at least three pre-manufactured rails having two sides and two ends with tenon provided at each end while each tenon has a predrilled aperture to receive locking rod;
c. at least one door panel; and
d. a set of rods to lock the rails to the stiles.

The set of rods should include two short locking rods of sufficient length to lock one rail to the stile and two long locking rods of sufficient length to lock at least two rails to the stile. More preferably, the set of rods has at least six locking rods to lock at least three rails to the stiles, and at least two pushing rods to deliver the locking rods into the distant mortises of the stile. Still more preferably, each stile has at least one locking rod, one pushing rod pre-inserted into its rod receiving slot proximate mortise, distant from one of the ends of the stile.

In yet another embodiment there will be an unlocking rod further positioned between the pre-inserted locking rod and pushing rod and a filler rod holding these rods in place during storage and delivery.

Preferably the kit also has at least one door extension member capable of being attached to at least one of the rails.

According to still another aspect of the invention there is provided a method of assembling a modular door comprising stiles with mortises, and rails with tenons, by the means of rods.

The method comprises insertion of the tenons of the rails into the mortises of the stiles followed by insertion of the rods into rod receiving slots of the stiles and apertures of the tenons, thus locking the rails inside the stiles. In a preferred embodiment at least one door panel is positioned between the rails and the stiles. Preferably two or more door panels are positioned between these rails and stiles.

The rods locking the rails inside each stile comprise at least one rod, and preferably more than two rods. The rods are selected from locking rods, pushing rods, filler rods, unlocking rods and combinations thereof.

According to yet another aspect of the invention, there is provided a method of assembling a modular door with at least two stiles with mortises and at least three rails with tenons, using rods. While the order of the steps can vary, the method has the following steps:

1. Insertion of a tenon of a first rail into the first mortise of the first stile;
2. Locking said tenon in said mortise with a first dowel or set of rods;
3. Positioning a first door panel adjoining said first rail and first stile;
4. Insertion of a tenon of a second rail in to the second mortise of the first stile while locking the first door panel in place;
5. Positioning a second door panel adjoining said second rail and the first stile;
6. Insertion of a tenon of a third rail into the third mortise of the first stile while locking the second door panel in place;
7. Locking the tenons of the second and the third rails in corresponding mortises by a set of rods;
8. Positioning the second stile on the side of the rails distant from the first stile, wherein the tenons of the rails are inserted into the corresponding mortises of the second rail and the first and second door panels are also locked in place; and
9. Locking the tenons of the rails in the second stile by the set of rods.

The assembled door does not require a use of glue or additional bonding agents during the assembly process.

The set of rods locking the rails inside each stile comprise at least one rod, and preferably more than two rods. The rods are selected from locking rods, pushing rods, filler rods, unlocking rods and combination thereof. Preferably, a set of bushings further locks the rods inside the stiles.

Additionally, the use of Plexiglas gives an even broader choice of uniqueness by shining light directly on to the Plexiglas and using it as a light conductor through the door body to shine out the other end without the use of wires.

Another aspect of the invention is the ability to take the door apart. Disassembly of the door brings a unique factor into effect. If a door is to be disassembled due to the size being increased, design change, and/or a damaged component in the door that needs replacing, these tasks may be done easily.

The end user can accomplish the above-named tasks by removing the screw penetrating the rail and bushing and, using the same screw, drive into the center of the bushing through the dowel leaving half the screw outside of the bushing. This will lock the bushing to the dowel. Using this as a clamping point, the rods that hold the tenons can be unlocked by simply removing the bushing/dowel at either ends of the door. Once completed, a rod of smaller diameter may be inserted. The length is determined by the following formula:

width of the tenon+plus length of bushing/dowel that was removed+one inch

The rod is then inserted into the door with force needed until the tip is flush with the door. Remove the rod and repeat this procedure for all the locks. The rails are unlocked from the stiles; the door can now be disassembled.

DETAILED DESCRIPTION OF THE PREFERRED EMBODIMENTS

Figure 1:
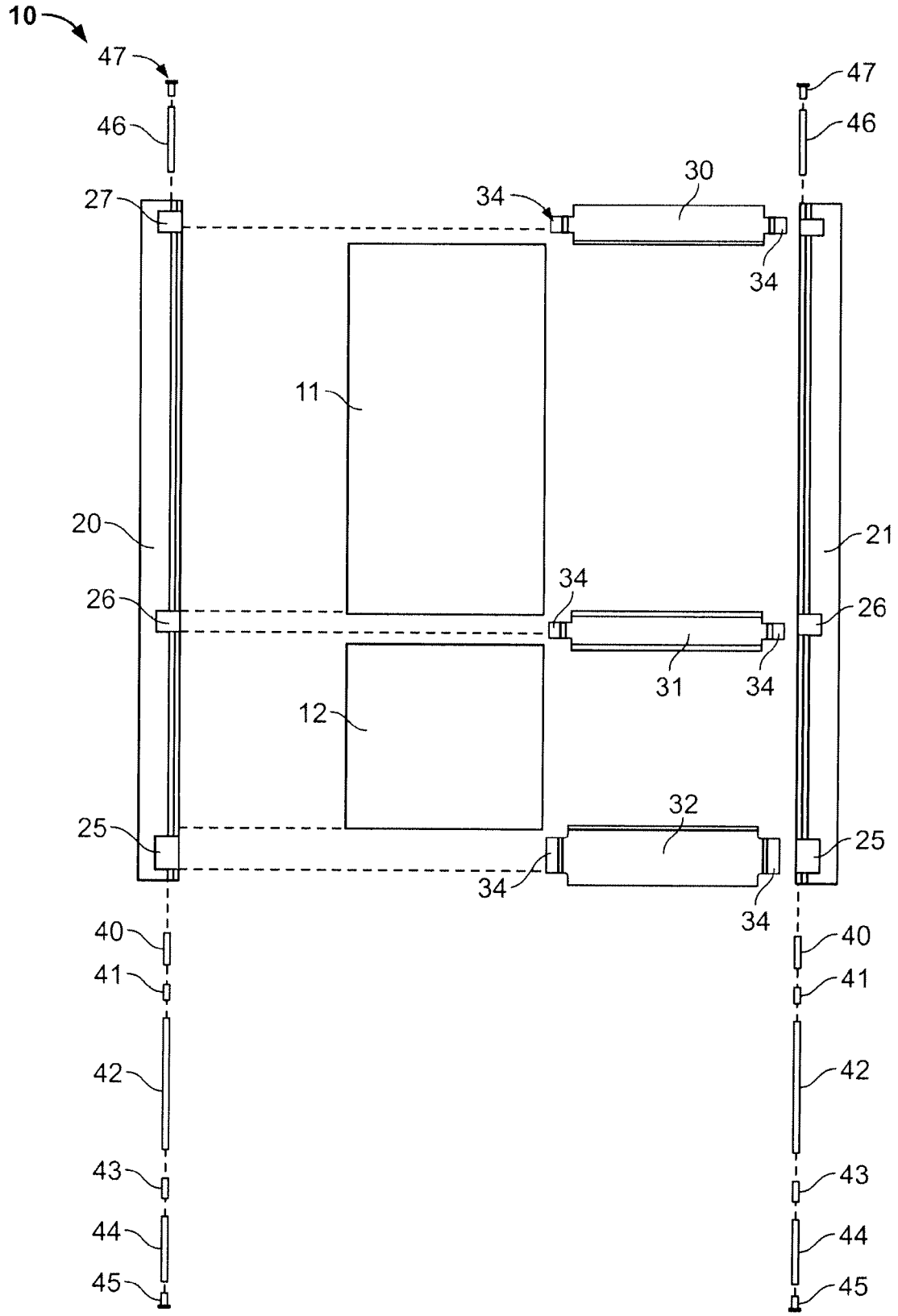
FIG. 1 is an exploded view of the modular door.

FIG. 1 illustrates an exploded view of the modular door 10. This modular door comprises a first stile 20, a second stile 21 and a minimum of a top rail 30 and a bottom rail 32. The door should also comprise at least one intermediate rail 31. Depending on the design requirements, the door may include additional horizontal rails between the top and bottom rails 30 and 32. Locked between the stiles and the rails, there are panels 11 and 12. The panels can be manufactured any way and from any material known to a person skilled in the art of door manufacturing, and the number of panels may vary according to the number of rails.

Figure 2:
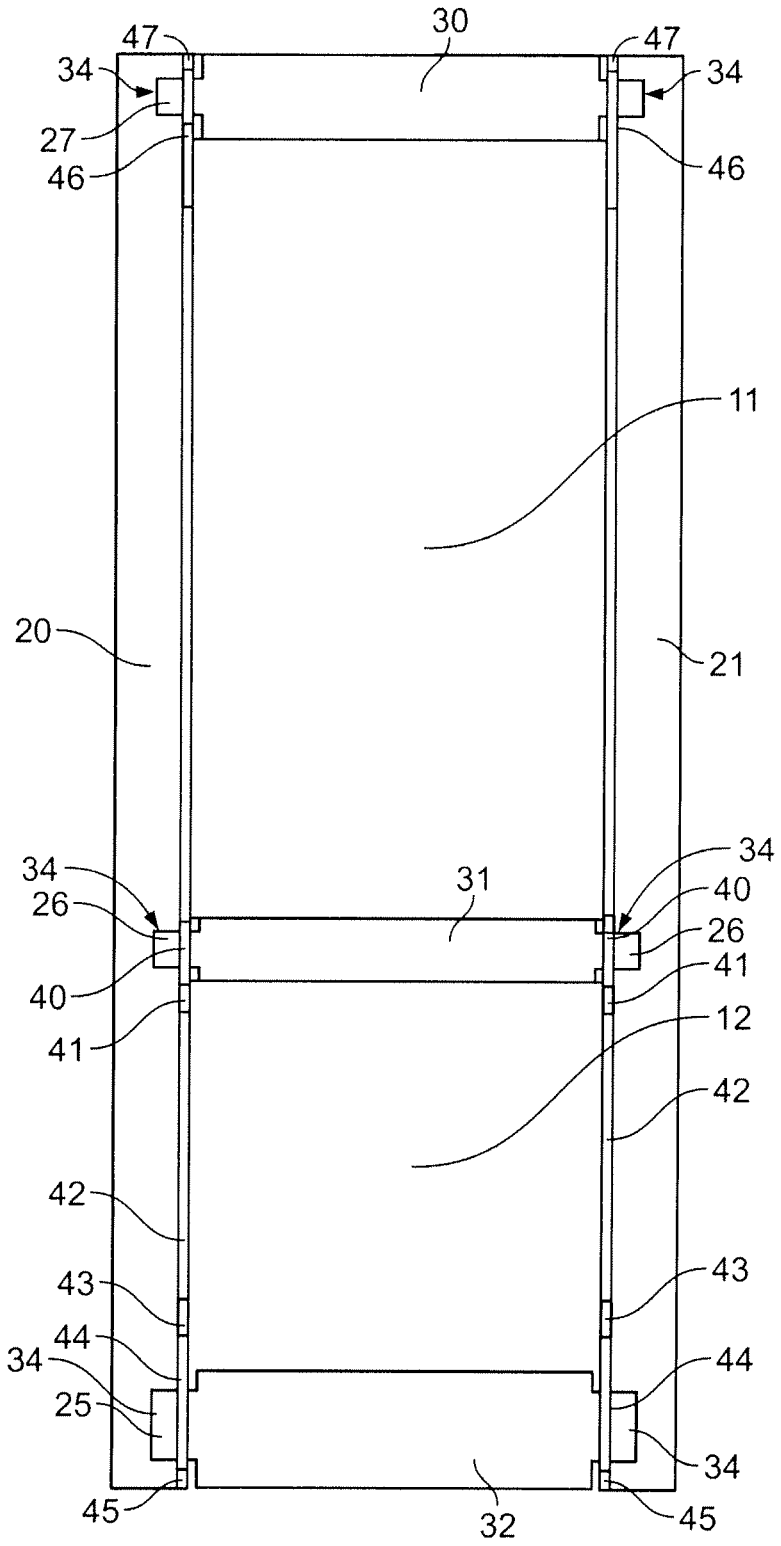
FIG. 2 is a see-through view of an assembled modular door.

Each stile comprises a plurality of mortises corresponding to a set of tenons positioned on the rails, best illustrated in FIG. 2, and there is a set of pins or dowels (40-44 and 46), which retain the tenons inside the mortises of each stile.

FIG. 2 illustrates rail 31 with tenon 34 positioned proximate to its corresponding mortise 26 in the stile 21 and rail 32, with tenon 34 positioned proximate to its corresponding mortise 25 in the stile 21 prior to the assembly process.

FIG. 2 illustrates the assembled door while the tenon 34 of rail 31 is completely inserted into the mortise 26 of stile 20 and locked in this position by the means of the dowel 40. Tenon 34 of rail 32 is fully inserted into the mortise 25 of stile 20 and locked in this position by the means of the dowel 44. Finally, tenon 34 of rail 30 is fully inserted into the mortise 27 of the stile 20 and locked in its position by the dowel 46. Rails 30, 31 and 32 are fixed to the stile 21 on the opposite side of the door, in the same manner as they are fixed to the stile 20.

As illustrated in FIG. 2, panel 11 is locked between rails 30 and 31 and by stiles 20 and 21, while panel 12 is locked between the stiles 20 and 21 and rails 31 and 32.

Figure 3:
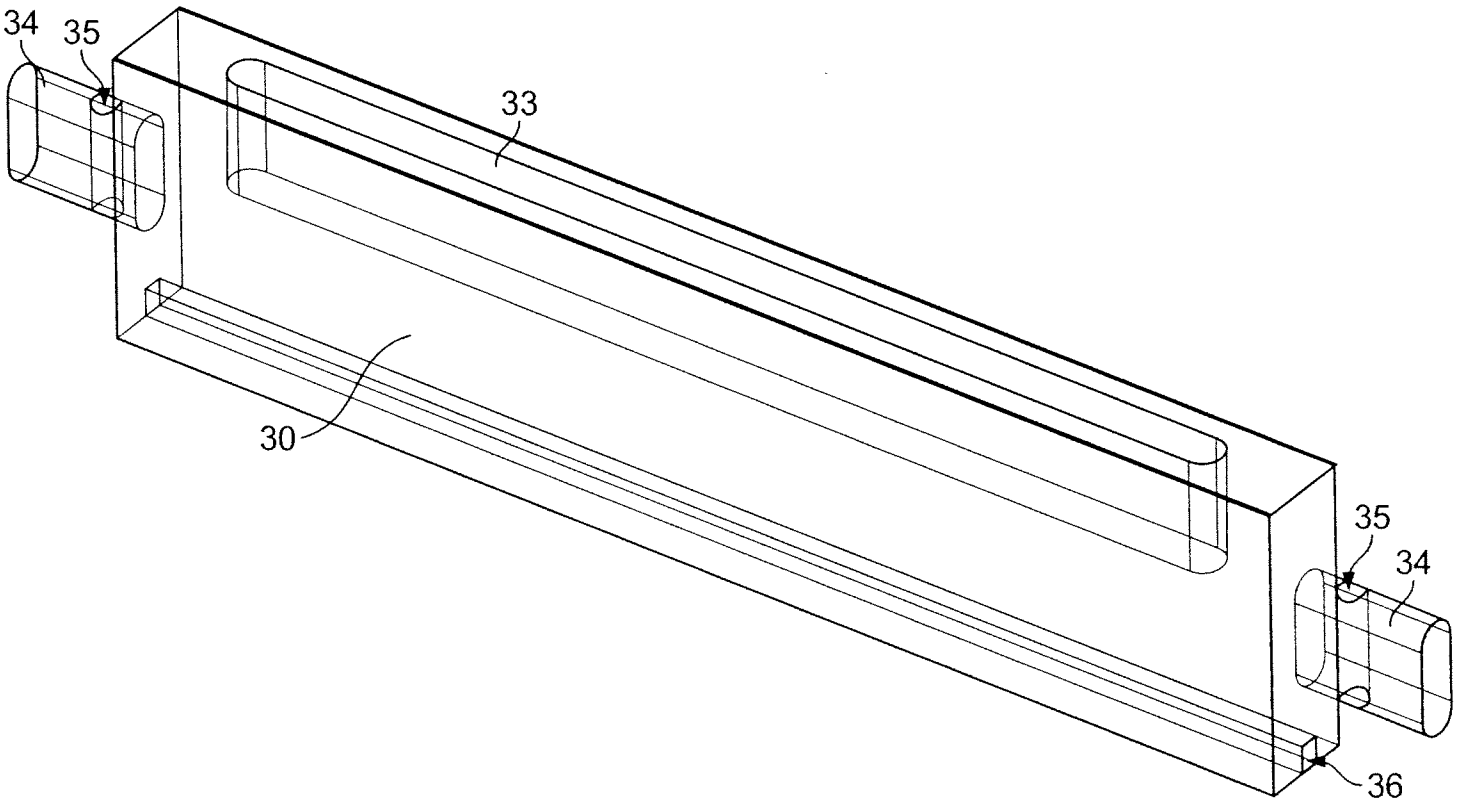
FIG. 3 is an elevated see-through view of a rail of the modular door.

Manufacturing Process of Rail: see FIG. 3

1. Rail 30 is squared.
2. Groove 36 is cut vertically on one side of rail 32 down the center of the rail so a panel 11 can be inserted into this groove during the door assembly.
3. The pair of tenons 34 is created on each end of the rail 32.
4. Protrusions 35 are drilled in each tenon. These protrusions receive the dowels locking them inside the mortises of the stiles.
5. In one of the embodiments, top rail 30 and/or bottom rail 32 may have an extra mortise 33 on a side opposite the groove 36 in order to receive an extension 37. In yet another alternative embodiment the bottom rail 32 can also have a mortise 33 to receive a bottom extension 37. All the intermediate rails 31 have two grooves 36 to receive the panels on both sides.
6. Preferably a chamfer is applied to the tenon for better seating on assembly of the door.

In one embodiment, the bottom rail 32 and top rail 30 are identical and can be used interchangeably to reduce the number of manufactured pieces of the door. In yet another embodiment (not shown), rails 30, 31 and 32 may be identical thus the groove 36 on both sides of the rail can be used to receive a panel 12 or extension 37.

Figure 7:
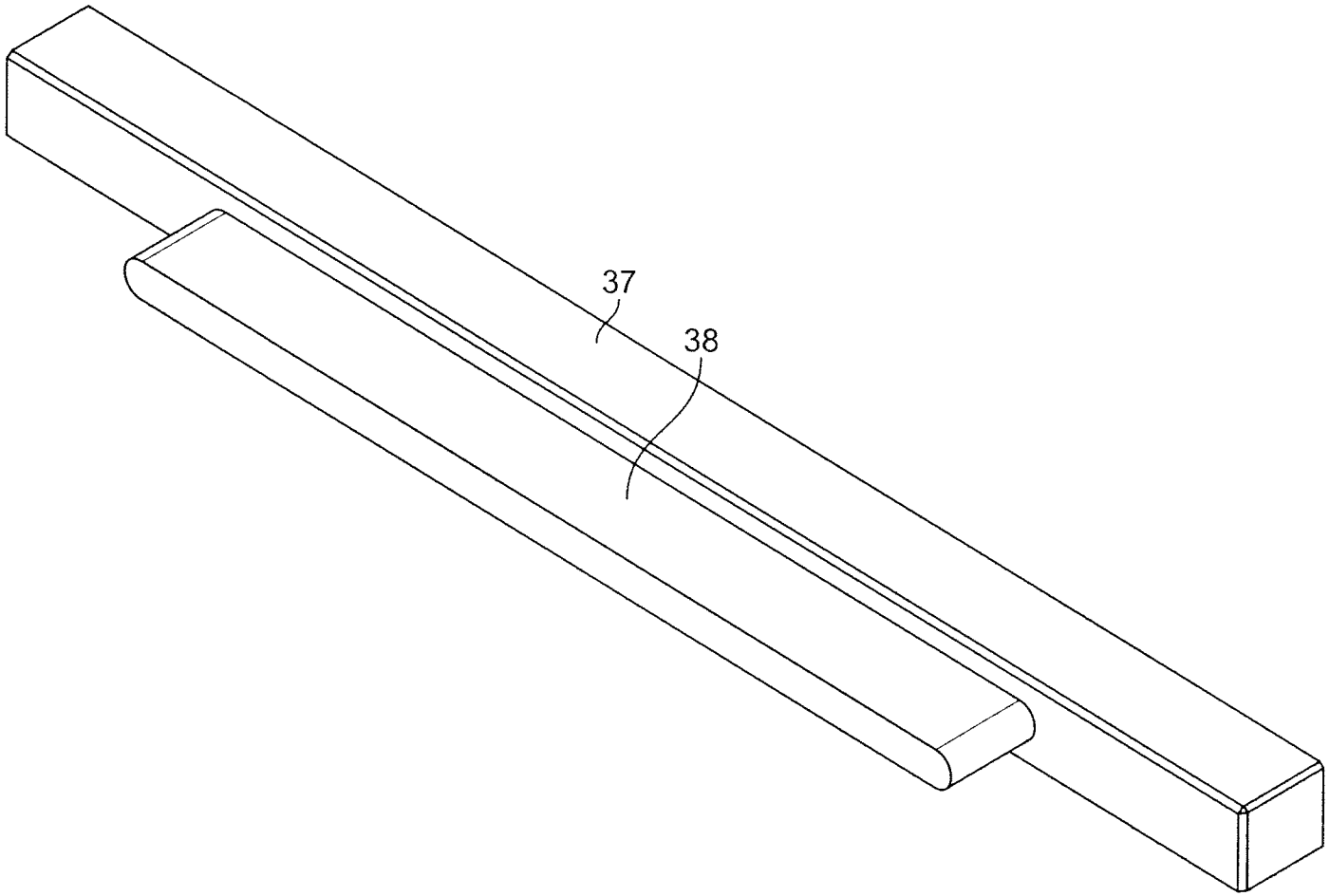
FIG. 7 is an elevated view of the extension insert into the rails.
Figure 8:
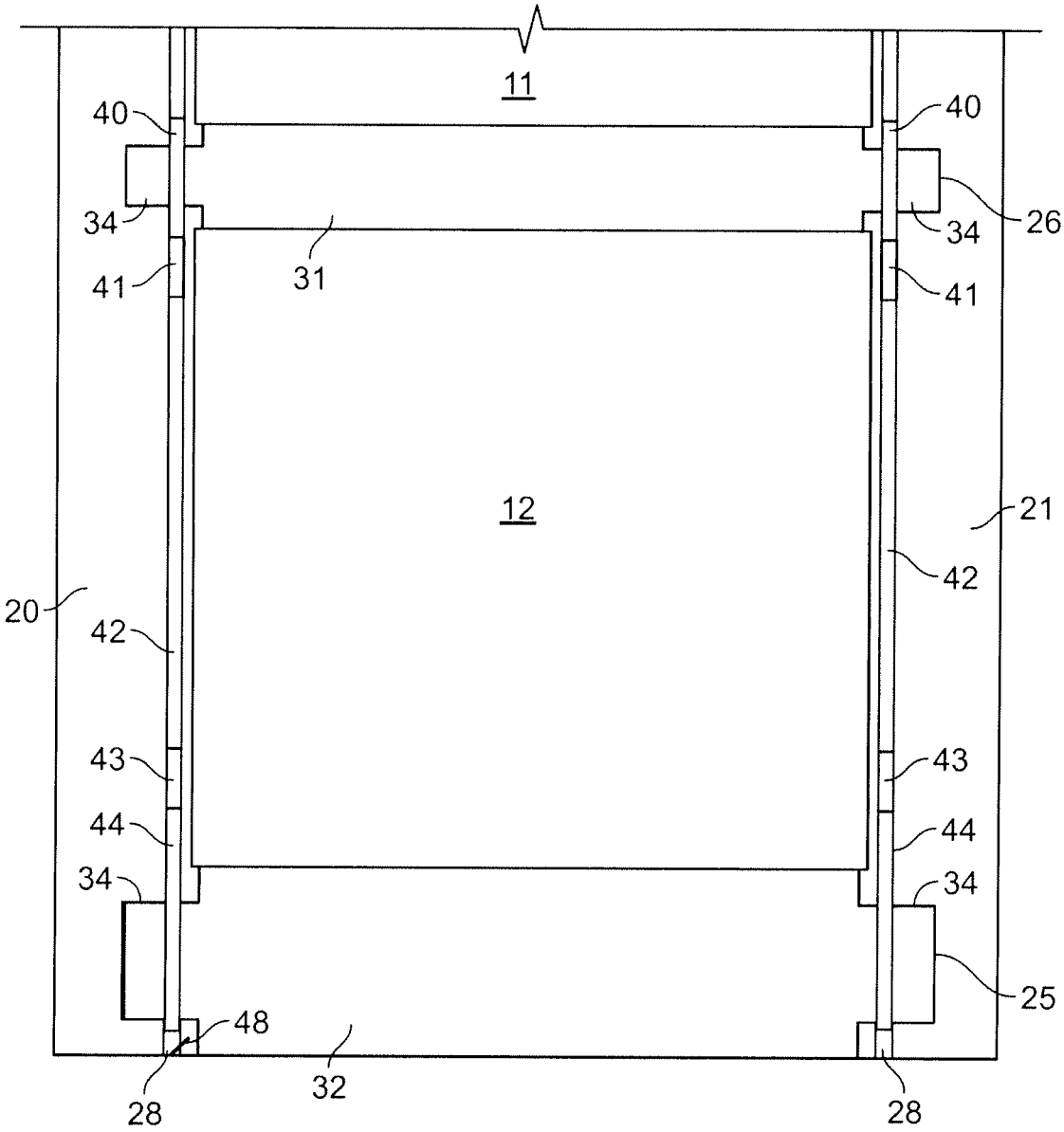
FIG. 8 is see through partial view of the bottom part of the assembled door.

Referring to FIG. 7, extension 37 to the door can be added to the top rail 30, bottom rail 32 or both by the means of insertion a mating member 38 into the receiving member 33 of the rails. The mating member 38 can be of any type known in the art such a ridge, tenon, and a plurality of pins, etc.

The extensions can vary in height, preferably from ¾" to 10" dependent on the manufacturing materials and design. Extension 37 can be constructed from various materials such as metals, wood, plastics and composite materials. Each extension 37 can be rubberized, painted or coated to protect the insert from elements and wear.

Figure 4:
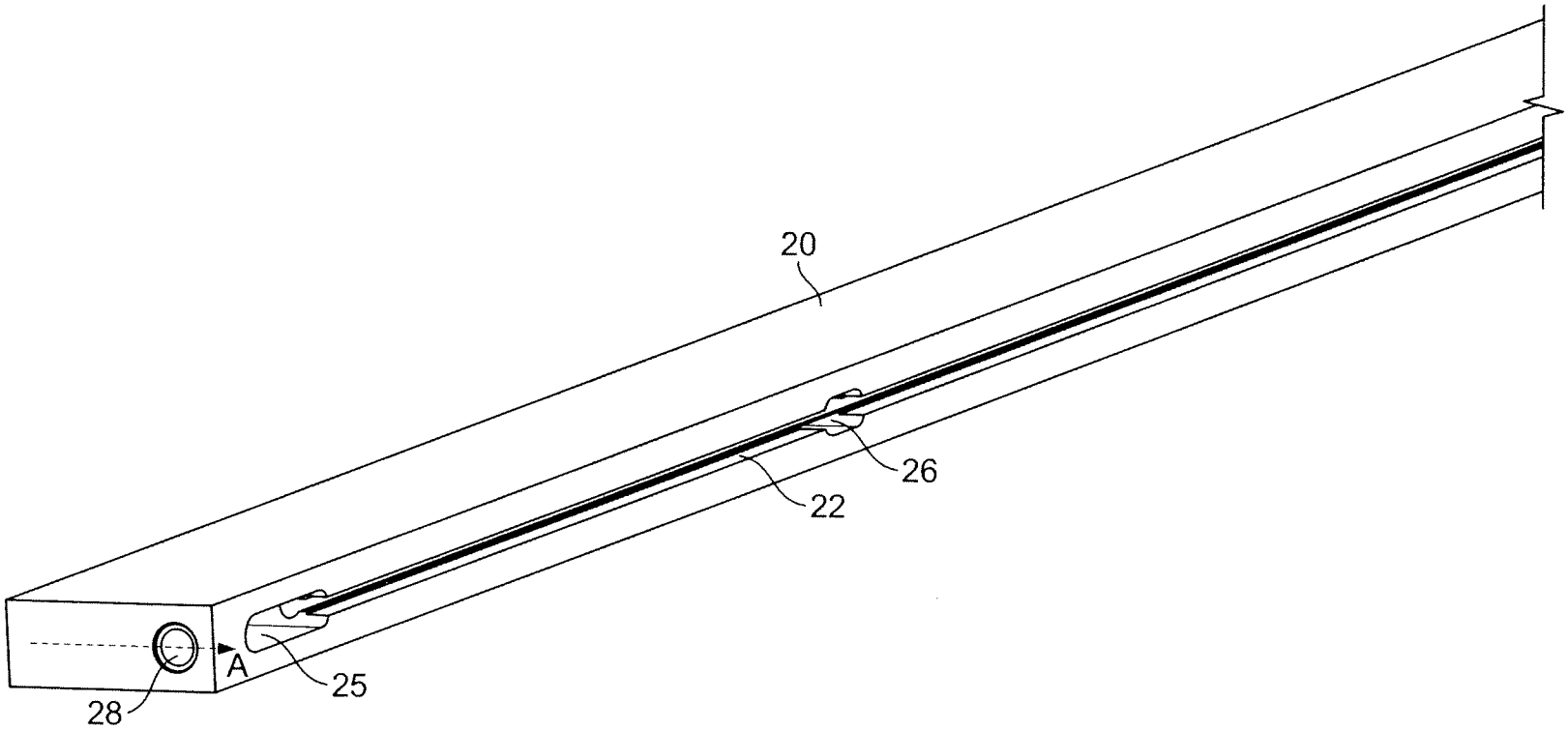
FIG. 4 is an elevated view of a stile.
Figure 5:
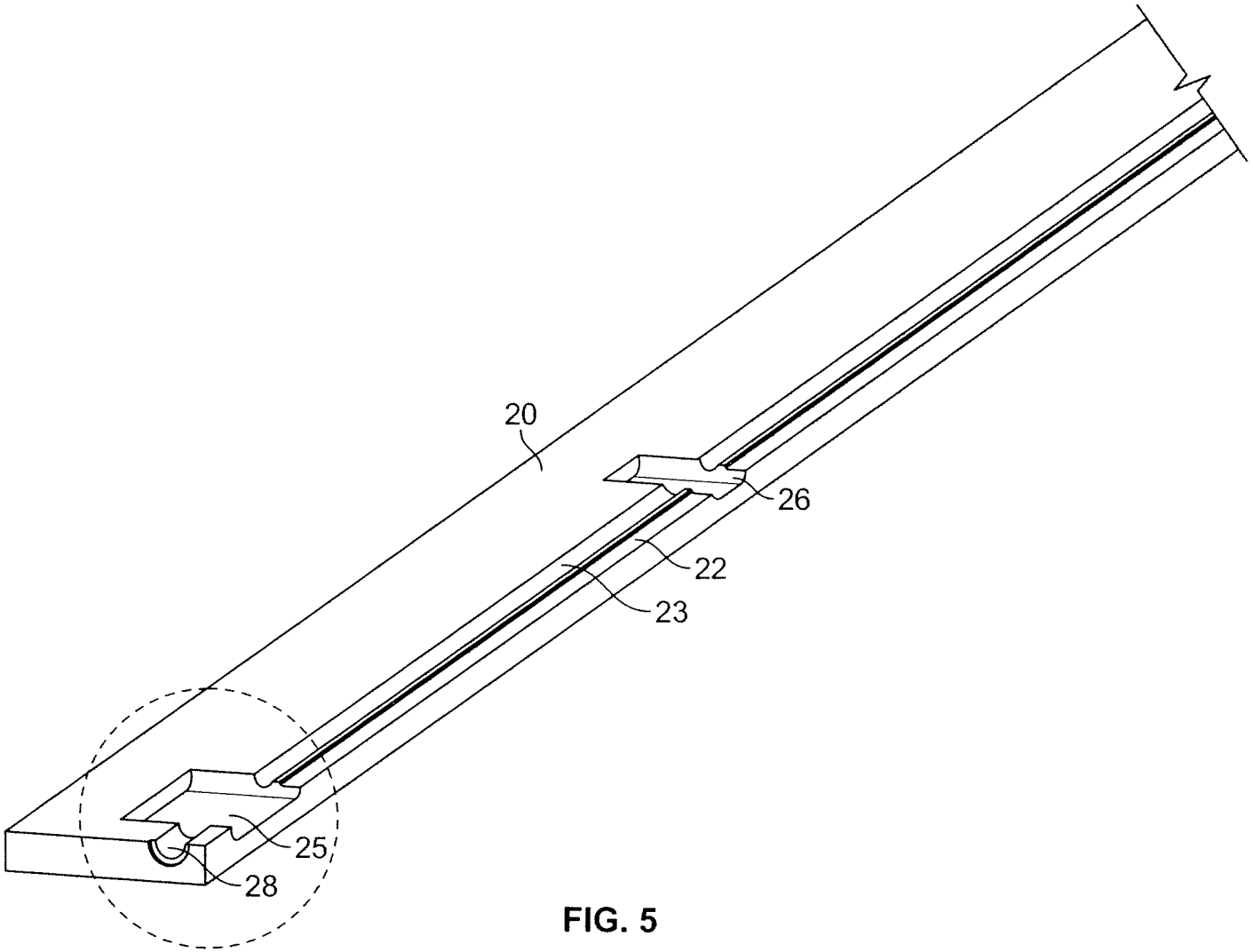
FIG. 5 is a cut view of FIG. 4 through line A-A.
Figure 6:
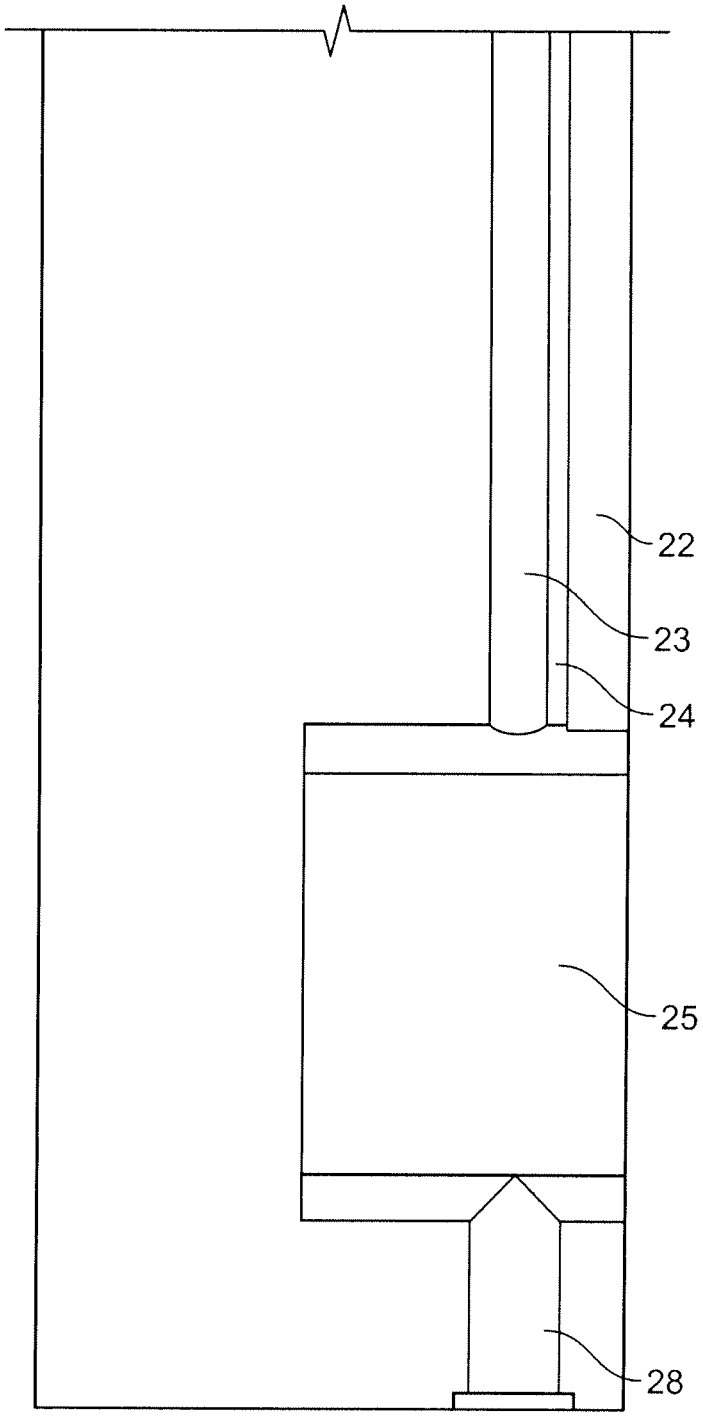
FIG. 6 is an enlarged top view of area B of FIG. 5.

Manufacturing Process of Stile Refereeing to FIGS. 4-6:

The manufacturing process of stile 20 is similar to the manufacturing process of the stile 21. The only difference is the preparation and positioning of the hardware on these stiles.

1. The stile 20 is squared and beveled. This is different from the existing assembly technology, where beveling is done after the door assembly.
2. A number of mortises including 25, 26, 27 and others, are cut into stile 20 according to design.

3. Groove 22 is cut down the center of stile 20 (opposite the bevel) so panels 11 and 12 can be inserted during an assembly process.
4. Slot 23 is provided down the center of the stile just short of the top and bottom keeping the integrity intact. This slot would receive rods/dowels, locking the tenons of the rails in the mortises of the stile. The slot 23 can be lined (not shown) with a plastic or metal sleeve in lieu of the wood. Slot 23 is placed a few millimeters behind groove 22 that holds the panels 11 and 12 in place in order not to lose the integrity of the groove 22.
5. Bushing holes 28 are drilled at the top and bottom of stile 20 continuing where the slots left off to accept a wood, plastic, Plexiglas or metal bushing/dowel.
6. In a preferred embodiment Illustrated in FIG. 16, at least some of the rods 40, 41, 42 and 43 are strategically pre-inserted into the slot 23 to save on assembly time of the finished door for the end user.

The rods/dowels have varied lengths, two of which are of smaller diameter and can be made of wood, plastic, Plexiglas, metal or other material known in the art. The length of the first rod 40 (locking rod) is the tenon 34 width plus two inches.

The second rod 41 (pusher/unlocking rod) has the width of the tenon 34 and a smaller diameter than rod 40.

The third rod 42 (pusher rod) is a few inches short of the following mortise, as well as being of smaller diameter, and the final rod 43 (filler rod) will fill the remaining gap to the edge of the mortise has the same diameter as the slot.

Figure 16:
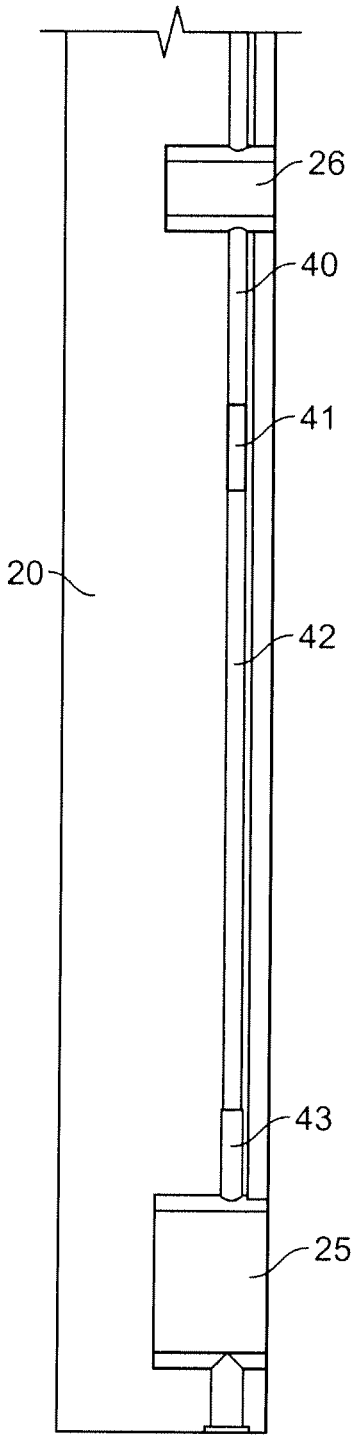
FIG. 16 is an illustration of stile with pre-inserted rods.

The lengths of the rods/dowels are determined by the design. If using multiple rails 31 and if locking from one side top or bottom, approximately 2 inches or the width of the tenon should be added to the locking rod 41 for every rail added.
7. As illustrated in FIG. 16, the first rod/pin/dowel 40 which will be referred to as the "locking rod" will be placed at the very edge of the center mortise 26. It will enter from the bottom or top of the stile from which a hole was created to accept a bushing (depending on design multiple mortises). Once it has entered the slot a small amount of force should be applied in order to bring it into place.

The second rod 41 "pusher/unlocking rod" will enter from the following mortise and be placed behind the first rod. Little to no force will be needed to position this rod, as this rod has a smaller diameter than the locking rods. The third "pusher rod" 42 will also use the same path as the first rod 40 and be placed directly against the unlocking rod 41. Little to no force will be needed to position this rod, as it too has a smaller diameter than the locking rod. The fourth and final filler rod" 43 will be placed against the pusher rod and enter from the mortise like the second rod (short in length). This filler rod is provided in order to keep all the pre-inserted rods in place during the transportation. A small amount of force will be needed to position this filler rod 44.

This may all be repeated depending on the design chosen.

Dowels/rods/pins 40, 41, 42, 43, 44, 46 are provided to lock the tenon inside the mortise, and to move the neighboring dowels into correct positions. Dowels will vary in diameter ¼" to 1". The material of the dowel will vary according to the design, size and weight of the door. The material can be selected from metals (such as steel or metal alloys), wood species, Plexiglas, plastics, etc.

According to yet another aspect of the invention, one long rod may replace all the rods 40-44, and this long rod may lock both rails 31 and 32 to the stile 20.

Figure 9:
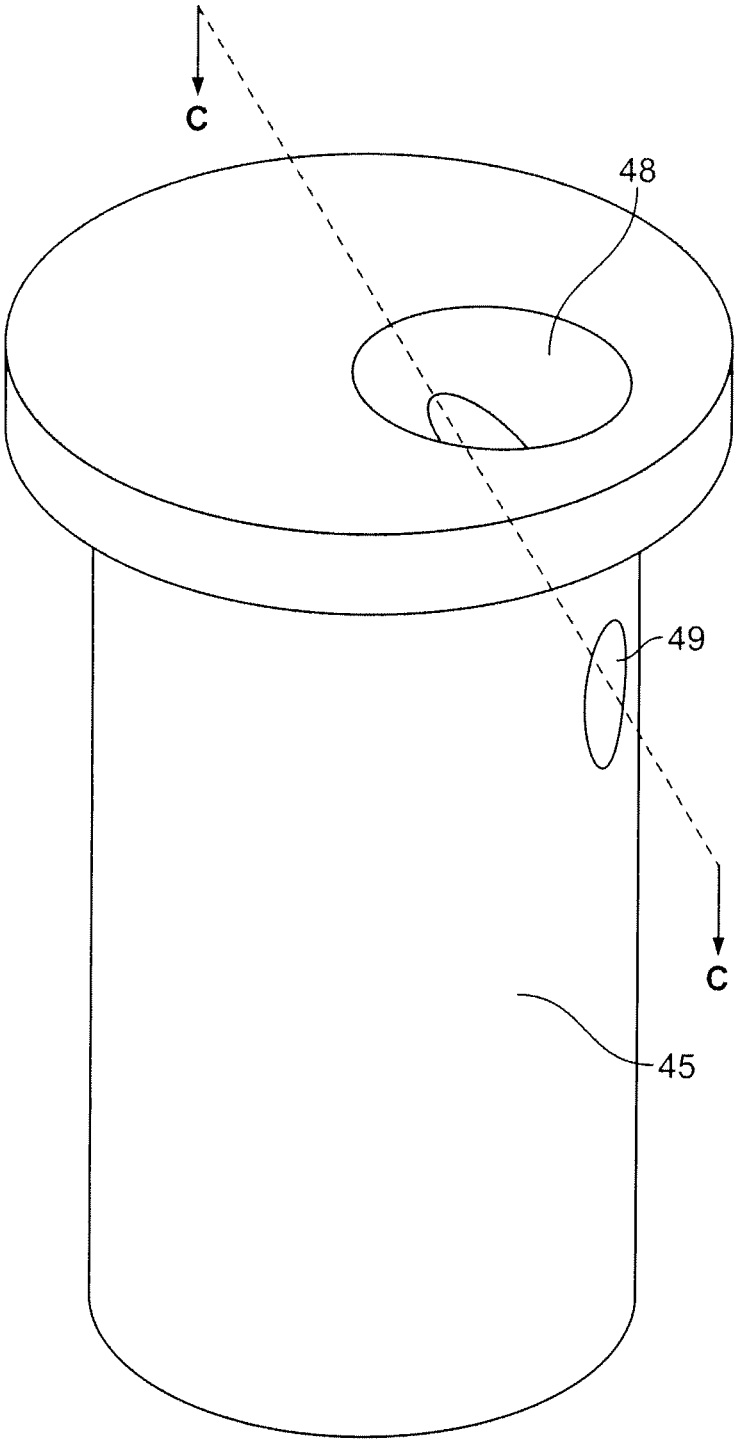
FIG. 9 is an elevated view of the bushing.

FIG. 9 provides an illustration of bushing 45. The bushing 45 as well as bushing 47 in FIG. 1, is provided to lock the pins/dowels in their position and to prevent movement of the dowels away from slot 23.

Figure 10:
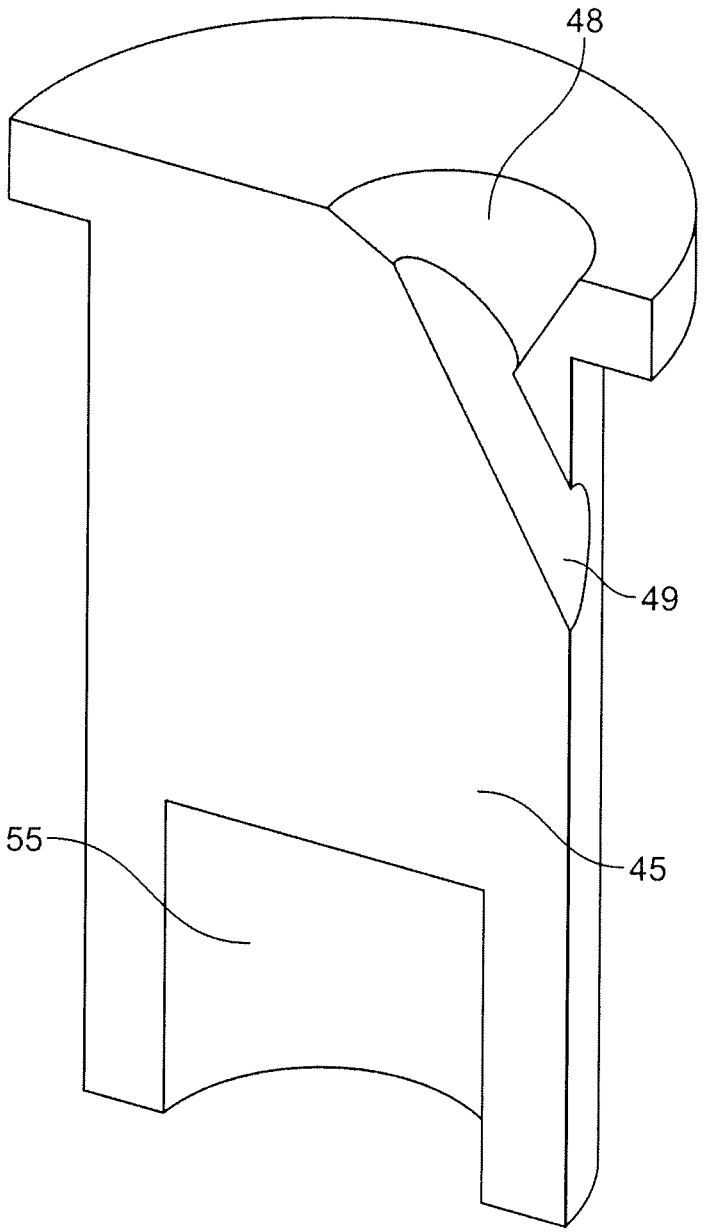
FIG. 10 is a cut view of FIG. 9 through line C-C.
Figure 11:
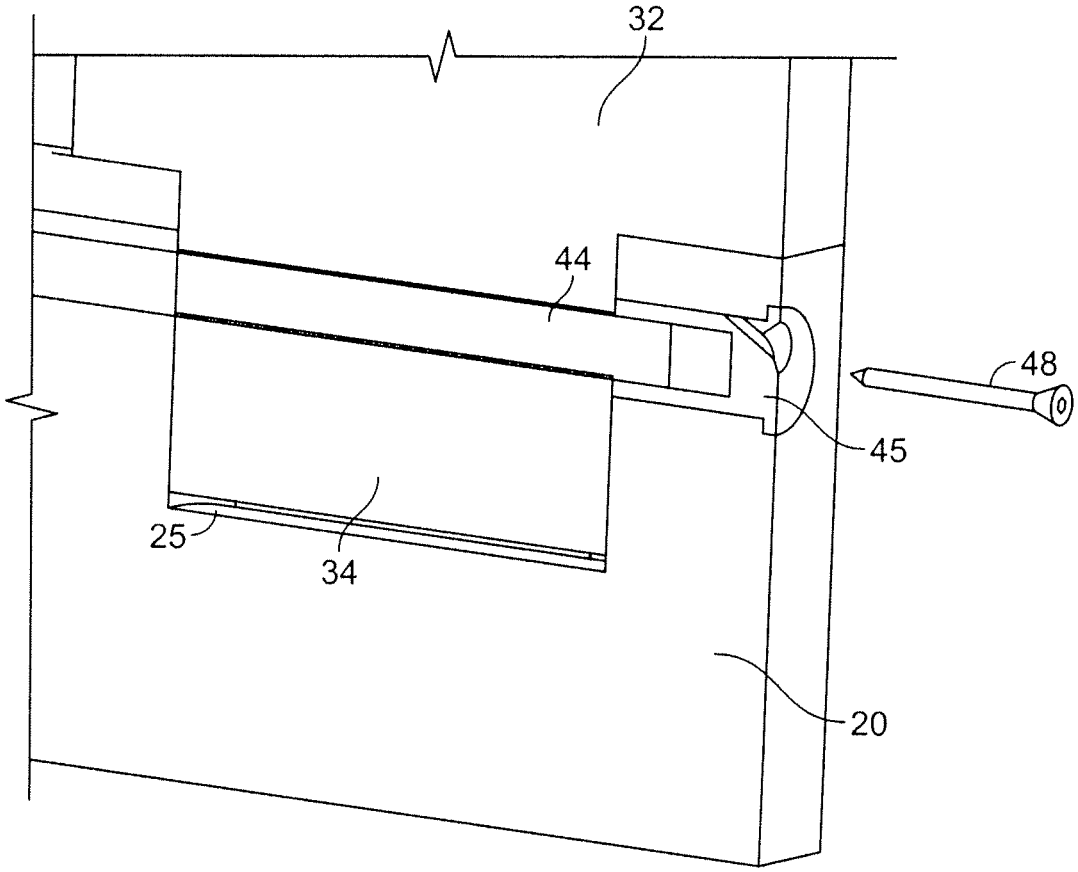
FIGS. 11-15 illustrate the process of disassembly of the modular door.
Figure 12:
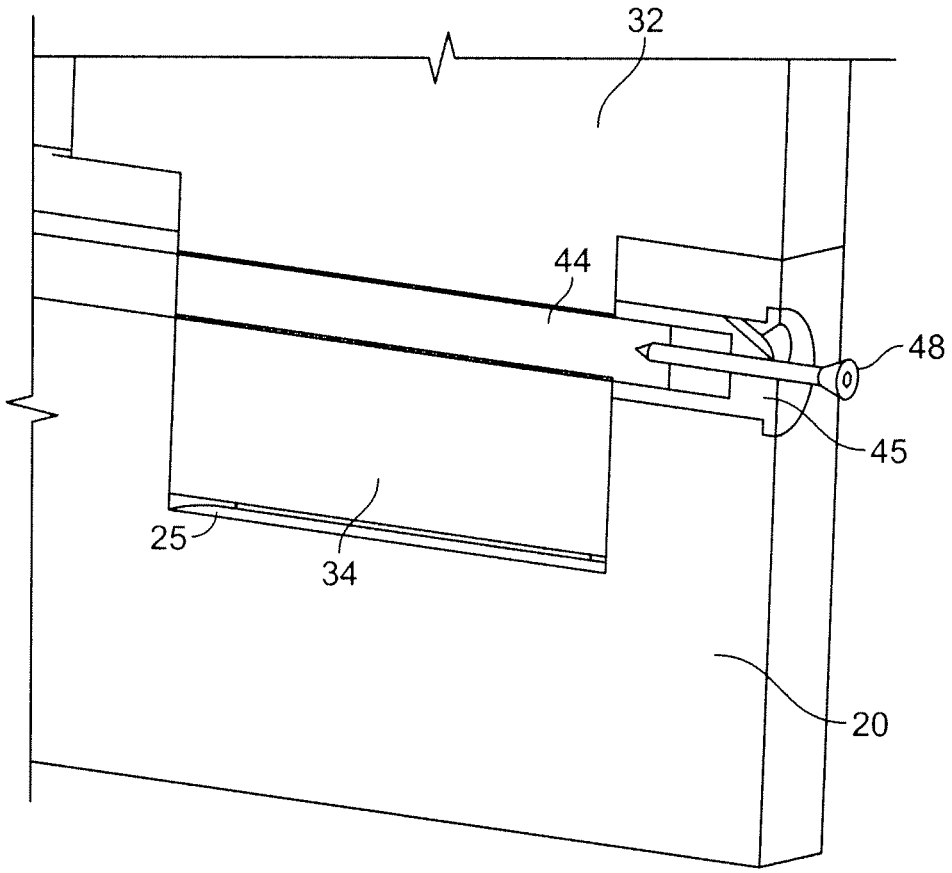
Figure 13:
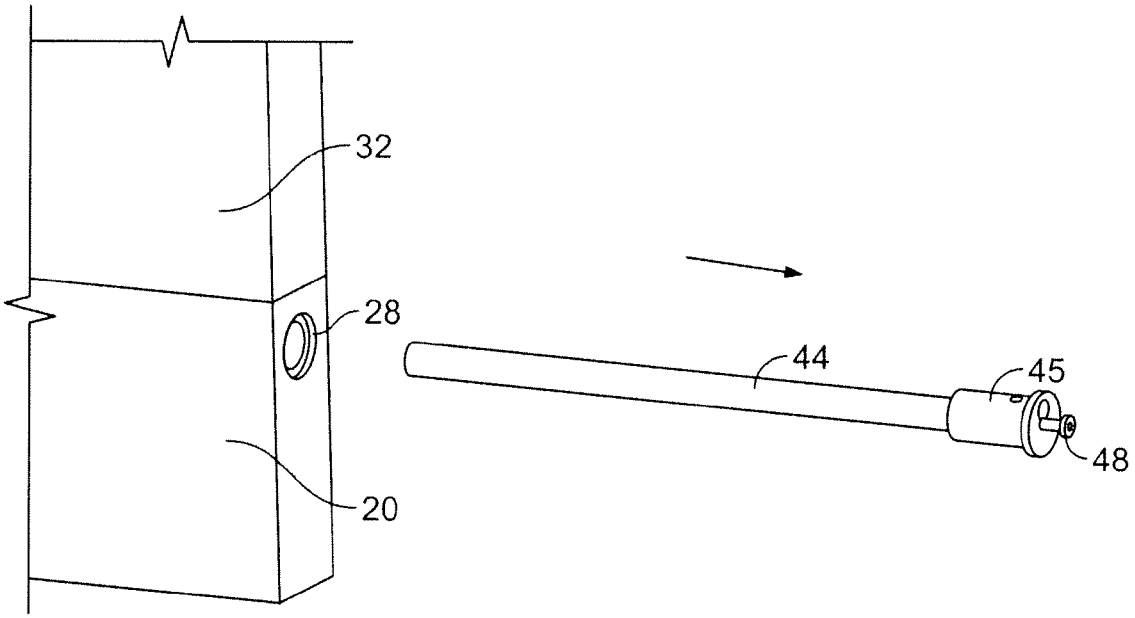
Figure 14:
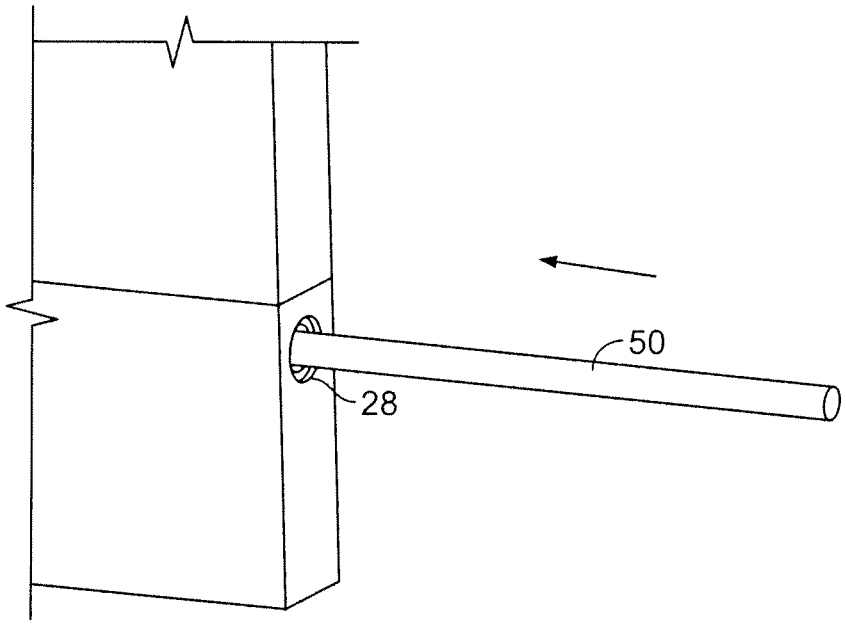
Figure 15:
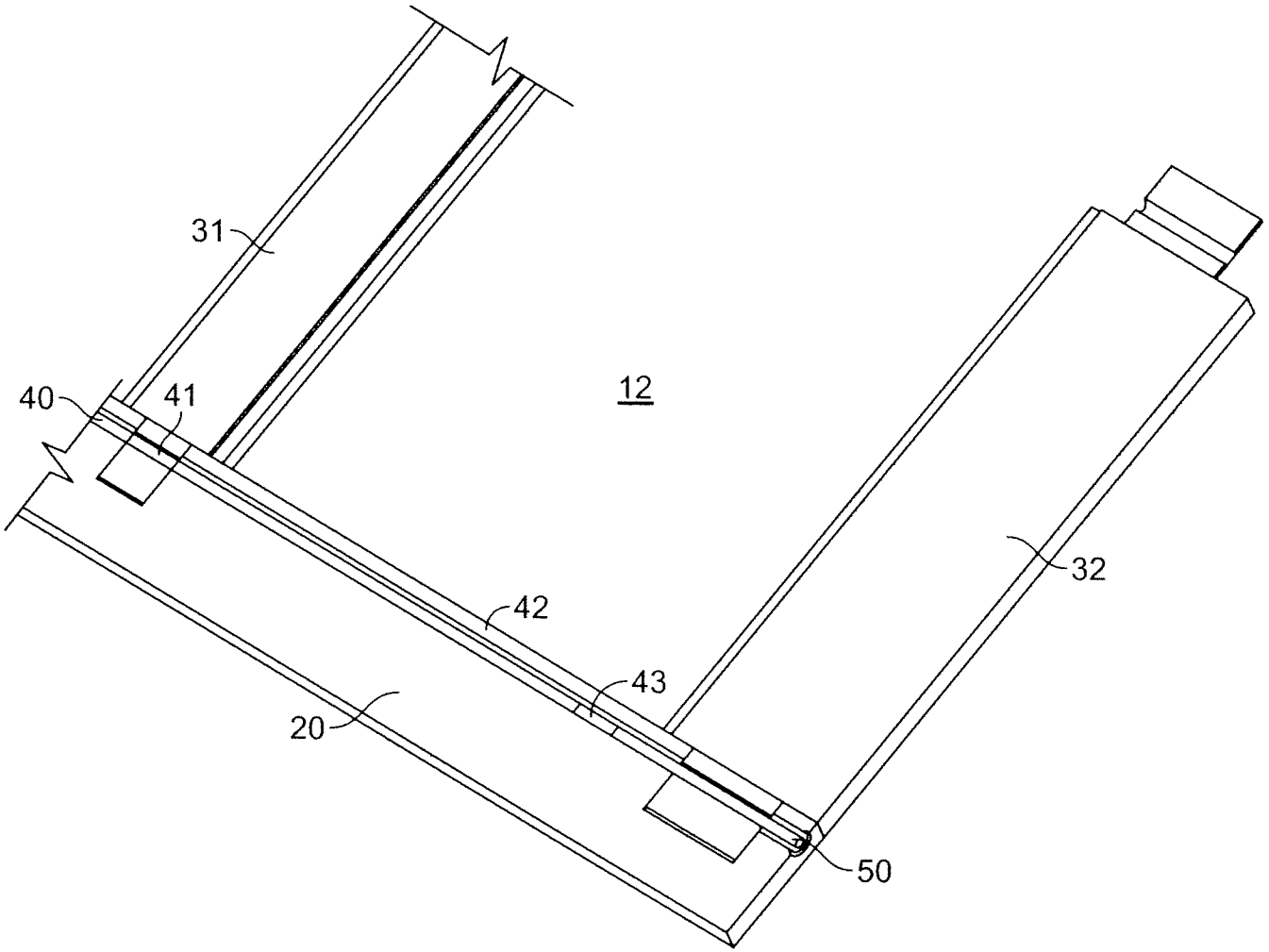

Bushing size will vary in length and diameter in lengths of 1" to 3" and diameters of ½" to 1⅝". The material of the bushing can be selected from metals such as steel or metal alloys, wood species, clear or colored Plexiglas, plastics, etc. In one preferred embodiment the bushing 45 is coupled with the bottom rail locking rod 44. This rod can be locked in the seat 55 (see FIG. 10) by any means known in the art. In addition, the bushing 45 has a tapered screw hole 48 allowing the bushing to be locked both to the stile 20 and rail 30.

In the same manner the bushing 47 may be coupled with the top locking rod 46.

Figure 17A:
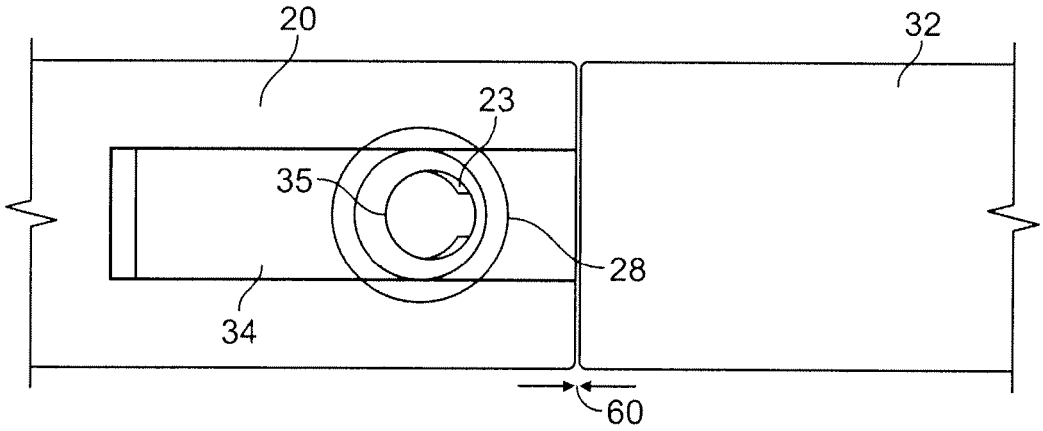
FIGS. 17A and 17B demonstrate the interaction of the rail and stile in locked and unlocked state.

FIGS. 17A and 17 B

Figure 17B:
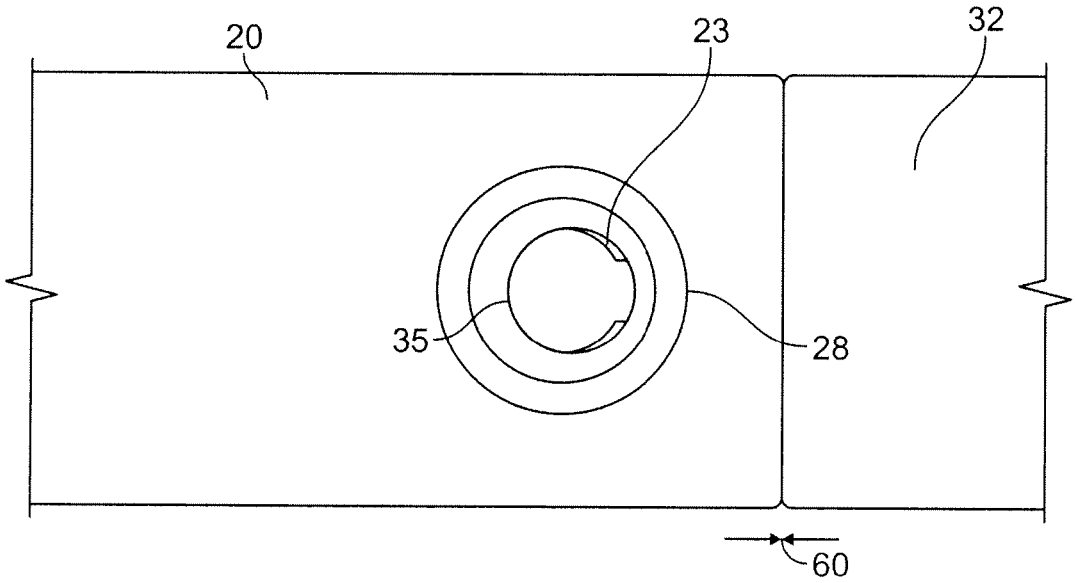

In a preferred embodiment, the protrusions 35 in the tenons 34 are created in an offset from the center line of the slot 23 of the stile 20, thus creating a pre-tensioned joint. This is done in order to create a pulling force on the tenons 34 into their corresponding mortises when the rods/dowels are inserted. This force therefore, closes the gap G between the two components (the gap G in FIG. 17B is smaller than the gap G in FIG. 17A). This force causes a tight attachment between the components and therefore eliminates the need of using a clamp press for gluing the door. Further, it virtually eliminates the use of glue in the door assembly process, making the process simpler, faster and economically effective.

Process of Assembly: see FIG. 1.

An example of the modular door assembly process is provided below.

In one of the embodiments, mortises, tenons, channels and dowels can be sprayed or covered with substances known in the art, to allow smooth insertions of tenons and dowels.

1. Stile 20 is positioned on a flat surface.
2. Top rail 30 is attached to the top of stile 20 with tenon 34 inserted into the mortise 27.
3. Dowel 46 is inserted with the appropriate force into its final resting position generating a force from the offset created in the manufacturing process to close the gap between the stile 20 and rail 30 and locking it into position.
4. Bushing 47 locks dowel 46 followed by driving a screw in an angle through the bushing 47 into the rail 30, locking the bushing to the stile 20 and rail 34 simultaneously. In a preferable embodiment the bushing 47 is coupled with the dowel 46 prior to insertion into the slot 28 to make the process of assembly more convenient and reducing the chance of damaging the dowel.
5. Insert panel 11 or panels if required by design into the panel grooves 36 and 22.
6. Insert the middle rail 31 and or multiple rails into the stile 20 (if required by design) by insertion of the tenon 34 into mortise 26.
7. Insert panel 12 (or panels if required by design) into the panel grooves 36 and 22.
8. Insert bottom rail 32 into the stile 20 by insertion of the tenon 34 into mortise 25.
9. Insert bottom bushing/dowel 44 with the appropriate force into its position, while at the same time pushing the pre-inserted rods 40, 41, 42 and 43 into their final resting position. This will generate force from the offset closing the gap between stile 20 and both the middle rail 31 and bottom rail 32 simultaneously.

Then drive a screw into the bushing 45, locking the bushing to rail 32 and stile 20.
10. Place stile 21 in is corresponding position and apply force bringing the stile down to its final seating, mating the tenon 34 of rail 30 with mortise 27, tenon 34 of rail 32 with mortise 26 a and tenon 34 of rail 32 with mortise 25.

11. Insert dowel 46 with the appropriate force into its final resting position generating force from the offset created in the manufacturing process to close the gap between stile 21 and rail 30 and locking it into position. Lock the dowel 46 with bushing 47, then drive a screw into the bushing 47 to connect it to the rail 30 and stile 21. (Preferably bushing 47 is coupled with dowel 46 as explained above.)
12. Finally, install dowel 44 with the appropriate force into its final resting position, while at the same time pushing the pre-inserted rods 40-43 into their final resting position, which will generate force from the offset to close the gap between both stile 21 and the mid and bottom rails 31 and 32 (and/or multiple rails) simultaneously.

Lock the dowel with bushing 45; drive a screw into bushing 45 to lock the rail 32 to the stile 21. (Preferably the bushing 45 is coupled with the dowel 44 as mentioned above.)

Alternatively, in a further embodiment of the invention, glue or another bonding agent can be added to all mortises and tenons to add strength to the door, if the door will not be disassembled. However, this addition of glue prior to assembly does not extend the assembly time since there is no need to wait for the glue to dry.

Process of Disassembly: FIGS. 11-15

There may come a time when a modular door may need to be disassembled to replace worn or damaged parts. If glue was not utilized during the assembly, disassembly is relatively easy.

Steps for the full disassembly of the modular door are provided below; but in most cases, a partial disassembly of the door will suffice.

1. Remove the screw locking the bushings to rail and stile. (See FIG. 11.)
2. Drive a screw through the center of the bushing into the dowel, locking dowel and bushing together. A good portion of the screw should be left protruding so that it can be used as an anchoring point for the bushing and dowel to be removed (See FIG. 12.)
3. Use the claw end of a hammer or other tool known in the art; remove the bushing and dowel attached by the screw, using a technique known to a person skilled in the art.
4. Repeat the above procedure with all bushings.
5. Using a rod 50, (preferably made of steel, with a substantially smaller diameter and having sufficient length to push the unlocking dowel 41 into the tenon 34 of the rail 31) remove the locking dowel 40 from the tenon 34 of the rail 31. Place it into the hole and drive it forward until the tip is flush with the edge of the door (see FIG. 15).
6. Rod 50 is then removed from the slot using tools known in the art. The rod 50 used to push the dowels may vary in length due to design.
7. The door can now be taken apart. The mortise and tenons are unlocked.

Advantages of the Modular Door Kit

1. Before assembly the stile can be machined for hardware installations such as hinges and or locks. A single stile simplifies handling, unlike manipulating the entire assembled door.
2. Shipping the components in a disassembled state makes the process of loading/unloading from dock level, truck, or condo elevator much easier to manage.
3. This novel process gives the customer on-the-spot flexibility in design, dimensions and integrity with multiple choices of materials and designs that can be used. For example, pre-manufactured parts of the door (such as the door panels) can be constructed from different materials to fit the custom design selected by the end user at the store.
4. This vast customization factor eliminates delays and reduces material and labour costs that are incurred as a matter of course when manufacturing custom doors.
5. After assembly is complete, the door can be installed immediately whether an end user chooses to assemble it with or without glue.
6. Do-it-yourself end users have the opportunity to assemble the door themselves, thus furthering labour cost savings.
7. The pockets 36 created on the top and bottom of the door rails provide the customer with an option of extending the height of a door to match high door openings, allowing an existing door to be reused rather than replaced. Depending on the chosen material, inserts 37 can make the door more resistant to the elements, increase its integrity or simply bring about a design change.
8. In a preferred embodiment, when the door is assembled without a bonding agent, the end user has the advantage of greater flexibility in design, dimensions, replacement of damaged components, or even disassembly that was not previously available.

In one of the alternative embodiments, by using a Plexiglas or other transparent material in bushing/dowel and rods the door can be illuminated. A light source can be placed on either the top or bottom of the door and, using the Plexiglas as a conductor to carry light through the door can create a unique look without the need to run any wires through the door.

Design options may include choosing transparent, semi-transparent, or light scattering features on selected parts of the door. For example, an illumination from the sill of the door can be transferred through hard transparent dowels to similarly constructed top and/or bottom rails, providing such a door with a unique illuminating feature. The transparent or otherwise light scattering inserts can be positioned in the rails, panels and even stiles.

The embodiments provided above are presented in an illustrative, not limiting way. Many changes and variations can be made to the embodiments without departing from the scope of the invention.

As many changes can be made to the preferred embodiment of the invention without departing from the scope thereof; it is intended that all matter contained herein be considered illustrative of the invention and not in a limiting sense.

I claim:

1. A modular door comprising:

a. A first pre-manufactured stile having two ends and two sides, and provided with mortises along one of the sides,
b. a second pre-manufactured stile having two ends and two sides, and provided with mortises along one of the sides,
c. each stile comprises a slot for receiving rods, wherein this slot extends from the top of the stile to the bottom of the stile passing through the mortises of the stile,
d. a top and bottom pre-manufactured rail having two sides and two ends with a tenon provided at each end while each tenon has an opening to receive a locking rod, said stiles and rails for enclosing at least one door panel,
e. at least one intermediate pre-manufactured rail having two sides and two ends with a tenon provided at each end, and each tenon has an opening to receive a locking rod, positioned between the top rail and the bottom rail;
f. said rails being attached to the first and second stiles by means of mortises and tenons fastened in place by the set of rods; and
g. set of rods comprising: locking rods of sufficient length to lock a single rail or a plurality of rails inside the corresponding stile; said modular door can be assembled by insertion of the tenons of the rails into the corresponding mortises of the stiles followed by locking in place with the set of rods;

wherein upon the insertion of each tenon into the corresponding mortise of each stile the rod receiving slot and aperture are positioned offset one to another, wherein upon insertion of the locking rod, each tenon is tightly locked into its corresponding mortise.

2. The modular door of claim 1 wherein the set of rods, further comprises pushing rods, locking rods, or locking/pushing rods, wherein the pushing rods are provided to push the locking rods into the tenons of the intermediate rail, and the locking/pushing rods are provided to lock one rail and also to push another locking or pushing rod through the rod receiving channel of the stile.

3. The modular door of claim 1 or 2 wherein the set of rods further comprises an unlocking rod having a length equal to the height of the tenon of the corresponding rail to be unlocked, these unlocking rods are positioned between the pushing rods and the locking rods, and can be pushed into the tenon of the rail while removing the locking rod from the tenon to release the intermediate rail from the stile.

4. The modular door of claim 1 wherein the top and/or bottom rails further comprise a receiving member to receive an extension to the door having a corresponding mating member, this extension to the door can be decorative or functional.

5. A kit for assembling a modular door comprising:

a. two pre-manufactured stiles having two ends and two sides, provided with mortises along one of the sides and a rod receiving slot passing through said mortises;

b. at least three pre-manufactured rails having two sides and two ends with a tenon provided at each end wherein each tenon has a predrilled aperture to receive a locking rod;

c. at least one door panel; and d. a set of rods to lock the rails to the stiles;

wherein said rod receiving slot and said predrilled aperture are offset to one another when said mortise and tenon are connected, creating a pulling force on the tenon and mortise when said rod is received in said slot and aperture;

said kit can be used to assemble a modular door which also can be disassembled.

6. The kit of claim 5 wherein the set of rods comprises two short locking rods of sufficient length to lock one rail to the stile and two long locking rods of sufficient length to lock at least two rails to the stile.

7. The kit of claim 5 wherein the set of rods comprises at least six locking rods to lock at least three rails to the stiles and at least two pushing rods to deliver the locking rods into the distant mortises of the stile.

8. The kit of claim 7 wherein the each stile has at least one locking rod and at least one pushing rod pre-inserted into its rod receiving slot proximate the mortise, distant from one of the ends of the stile.

9. The kit of claim 8 wherein an unlocking rod is positioned between the pre-inserted locking rod and pushing rod and a filler rod holds these rods in place during storage and delivery.

10. The kit of claim 5 further comprising at least one door extension member capable of being attached to at least one of the rails.

11. A method of assembling a modular door comprising:

a. pre-manufactured stiles having two ends and two sides, provided with mortises along one of the sides and rod receiving slots passing through said mortises, b. pre-manufactured rails having two sides and two ends with a tenon provided at each end while each tenon has an opening to receive a locking rod;

wherein said rod receiving slot and said opening are offset to one another when said mortise and tenon are connected, creating a pulling force on the tenon and mortise when said rod is received in said rod receiving slot and said opening;

said method comprises insertion of the tenons of the rails into the mortises of the stiles, followed by insertion of the rods into rod receiving slots of the stiles and the opening of the tenons, thus locking the rails inside the stiles.

12. The method of claim 11, wherein at least one door panel is positioned between the rails and the stiles.

13. The method of claim 12 wherein the rods locking the rails inside each stile comprise at least two rods, said rods are selected from locking rods, pushing rods, filler rods, unlocking rods and combinations thereof.

14. A method of assembling a modular door comprising at least two pre-manufactured stiles having two ends and two sides, provided with mortises along one of the sides and rod receiving slots passing through said mortises and at least three pre-manufactured rails having two sides and two ends with a tenon provided at each end wherein each tenon has an opening to receive locking rod, using a set of rods, the method comprises:

a. insertion of a tenon of a first rail into the first mortise of the first stile;

b. locking said tenon in said mortise with a first dowel or set of rods;

c. positioning a first door panel adjoining said first rail and first stile;

d. insertion of a tenon of a second rail in to the second mortise of the first stile while locking the first door panel in place;

e. positioning a second door panel adjoining said second rail and the first stile;

f. insertion of a tenon of a third rail into the third mortise of the first stile while locking the second door panel in place;

g. locking the tenons of the second and the third rails in corresponding mortises by a set of rods;

h. positioning the second stile on the side of the rails distant from the first stile, wherein the tenons of the rails are inserted into the corresponding mortises of the second stile and the first and second door panels are also locked in place; and i. locking the tenons of the rails in the second stile by the set of rods;

wherein said rod receiving slot and said opening are offset to one another when said mortise and tenon are connected, creating a pulling force on the tenon and mortise when said rod is received in said rod receiving slot and said opening;

wherein the assembled door, does not require a use of glue or additional bonding agents during the assembly process.

15. The method of claim 14 wherein the set of rods locking the rails inside each stile comprise at least one rod, and preferably more than two rods, wherein the rods are selected from locking rods, pushing rods, filler rods, unlocking rods and combinations thereof.

16. The method of claim 15 wherein a set of bushings further locks the rods inside the stiles.

* * * * *